US007830331B2

(12) United States Patent
Yamazaki et al.

(10) Patent No.: US 7,830,331 B2
(45) Date of Patent: Nov. 9, 2010

(54) ELECTRONIC DEVICE

(75) Inventors: Fuminori Yamazaki, Fussa (JP); Kentaro Tomioka, Sayama (JP); Tomomi Murayama, Tokyo (JP); Toshio Ooe, Oume (JP); Satoshi Yokote, Oume (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 125 days.

(21) Appl. No.: 12/233,365

(22) Filed: Sep. 18, 2008

(65) Prior Publication Data

US 2009/0140934 A1 Jun. 4, 2009

(30) Foreign Application Priority Data

Nov. 29, 2007 (JP) ..... 2007-309231

(51) Int. Cl.
*H01Q 1/50* (2006.01)
*H01Q 1/24* (2006.01)
*H01Q 1/42* (2006.01)

(52) U.S. Cl. ..... 343/906; 343/702; 343/872

(58) Field of Classification Search ..... 343/702, 343/700 MS, 906, 872, 873; 455/575.1–575.9, 455/90.1–90.3

See application file for complete search history.

(56) References Cited

U.S. PATENT DOCUMENTS 6,512,491 B2 * 1/2003 Kanayama et al. ..... 343/883
6,642,907 B2 * 11/2003 Hamada et al. ..... 343/873
2006/0170597 A1 * 8/2006 Kurashima et al. .... 343/700 MS
2008/0150815 A1 * 6/2008 Nakahata et al. ..... 343/718

FOREIGN PATENT DOCUMENTS

| | | |
|---|---|---|
| JP | 04-211189 | 8/1992 |
| JP | 05-28917 | 2/1993 |
| JP | B2-5-028917 | 4/1993 |
| JP | 7-273685 | 10/1995 |
| JP | 11-355023 | 12/1999 |
| JP | 2001-267727 | 9/2001 |

OTHER PUBLICATIONS

Notfication of Reason for Refusal received in corresponding Japanese Patent Application No. 2007-309231, mailed Jan. 27, 2009, 8 pages.

* cited by examiner

*Primary Examiner*—Hoang V Nguyen
*Assistant Examiner*—Robert Karacsony
(74) *Attorney, Agent, or Firm*—Knobbe, Martens, Olson & Bear LLP

(57) ABSTRACT

An electronic device includes: a circuit board that has a wireless communication module that is mounted thereon and a feed line that is formed on the circuit board and electrically connected to the wireless communication module; a planar member that is formed with an opening and has a flexible planar piece that is formed to protrude toward the circuit board from an edge of the opening; and an antenna pattern that includes an antenna part that is formed on the planar member and a feeder part that is formed on the flexible planar piece, wherein circuit board and the planar member are arranged to be in positions to flexibly bend the flexible planar piece by the circuit board to electrically connect the feeder part of the antenna pattern and the feed line formed on the circuit board.

6 Claims, 6 Drawing Sheets

ELECTRONIC DEVICE

CROSS-REFERENCE TO RELATED APPLICATIONS

This application is based upon and claims the benefit of priority from Japanese Patent Application No. 2007-309231, filed on Nov. 29, 2007, the entire content of which are incorporated herein by reference.

BACKGROUND

1. Field

One embodiment of the present invention relates to an electronic device having a wireless communication function.

2. Description of the Related Art

In recent years, as the function of an electronic device, such as a personal computer and a cellular phone, is more improved, the number of wireless communication modules or the number of antennas mounted in the electronic device is increased. In one structural form of the electronic device having a wireless communication function, the wireless communication module is mounted on a printed circuit board on which various types of electronic components are mounted and the antenna is disposed as a part of other parts separate from the printed circuit board.

A document JP-B2-5-028917 discloses a printed circuit board on which electronic components are mounted. In the configuration disclosed in the document JP-B2-5-028917, a plastic member is disposed on the circuit board to protrude upward from the surface of the circuit board in a cantilever shape. The plastic member is provided with a conductive layer, which is electrically connected to the terminals of the electronic component, and serves as a connector for the electronic component. However, the document JP-B2-5-028917 does not disclose any a communication module or an antenna pattern.

When the electronic device having the wireless communication function is formed by mounting the wireless communication module on the printed circuit board and mounting the antenna on parts other than the printed circuit board, a special connector that connects the wireless communication module on the printed circuit board to the antenna is required. Such special connector is interposed between the printed circuit board and the antenna and should be provided with a spring for securing a stable connection between the printed circuit board and the antenna.

However, providing such special connector causes the number of parts of the electronic device to be increased. Further, when such special connector is provided, the structure of the electronic device becomes complicated, causing a product cost to be increased.

SUMMARY

According to one aspect of the present invention, there is provided an electronic device including: a circuit board that has a wireless communication module that is mounted thereon and a feed line that is formed on the circuit board and electrically connected to the wireless communication module; a planar member that is formed with an opening and has a flexible planar piece that is formed to protrude toward the circuit board from an edge of the opening; and an antenna pattern that includes an antenna part that is formed on the planar member and a feeder part that is formed on the flexible planar piece, wherein circuit board and the planar member are arranged to be in positions to flexibly bend the flexible planar piece by the circuit board to electrically connect the feeder part of the antenna pattern and the feed line formed on the circuit board.

BRIEF DESCRIPTION OF THE SEVERAL VIEWS OF THE DRAWINGS

A general configuration that implements the various feature of the invention will now be described with reference to the drawings. The drawings and the associated descriptions are provided to illustrate embodiments of the invention and not to limit the scope of the invention.

DETAILED DESCRIPTION

Figure 1:
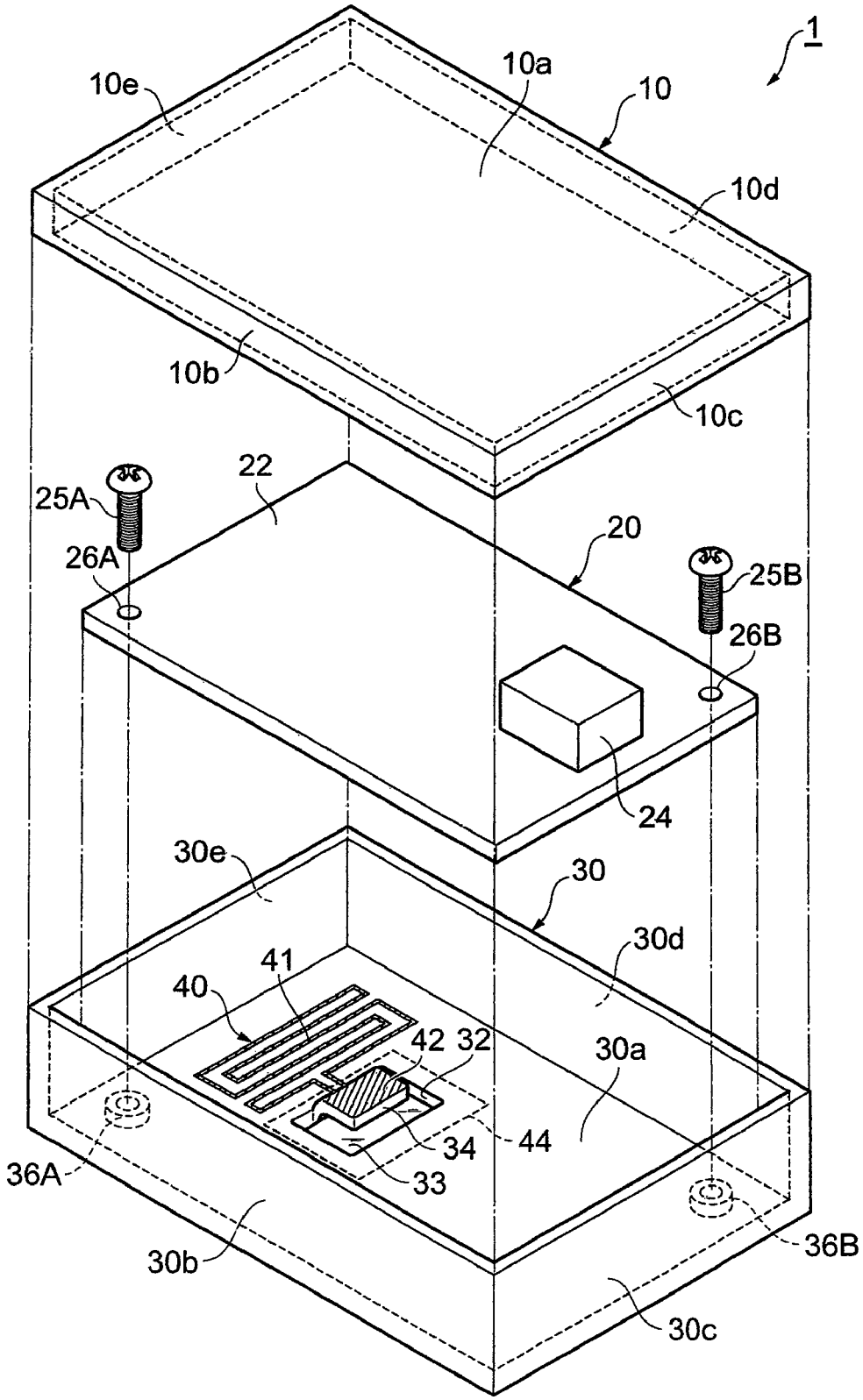
FIG. 1 is an exploded view of a portable electronic device having a wireless communication function according to an embodiment.

A detailed explanation will be given of an embodiment of the present invention with reference to the accompanying drawings. FIG. 1 is a block diagram showing a content reproducing system having a stream supplying apparatus and a content reproducing apparatus according to an embodiment of the present invention.

FIGS. 1 to 5 show an electronic device 1 according to an embodiment of the present invention. The electronic device 1 is assumed to be a portable electronic device, such as a notebook type personal computer or a cellular phone. As the function of the electronic device 1 is more improved, the number of wireless communication modules 24 mounted on the electronic device 1 and the number of antenna patterns 40 are increased. FIGS. 1 to 5 show a state in which the wireless communication module 24 mounted on a printed circuit board 20 is connected to the antenna pattern 40 formed in a case 100.

Figure 2:
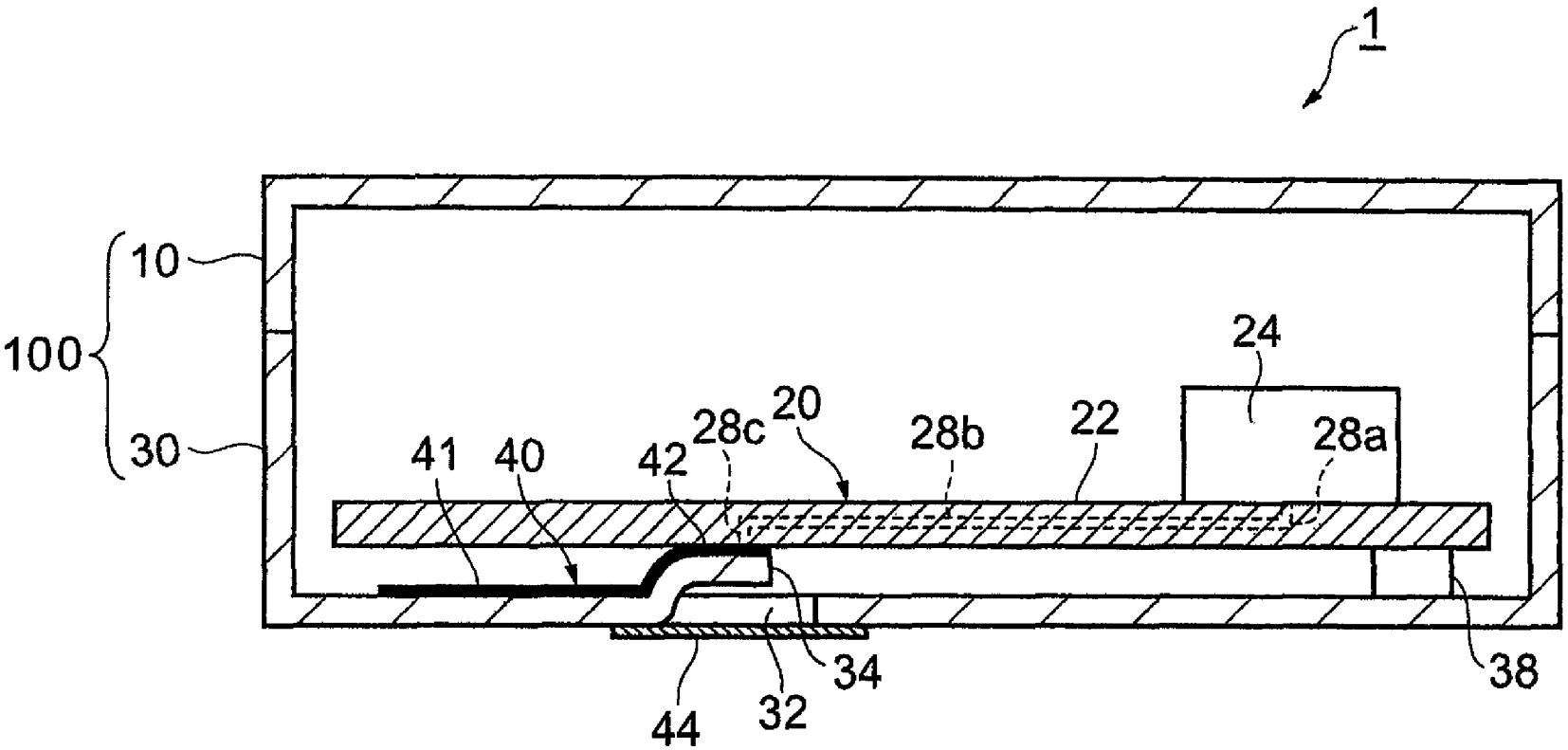
FIG. 2 is a sectional side view of the portable electronic device according to the embodiment.
Figure 3:
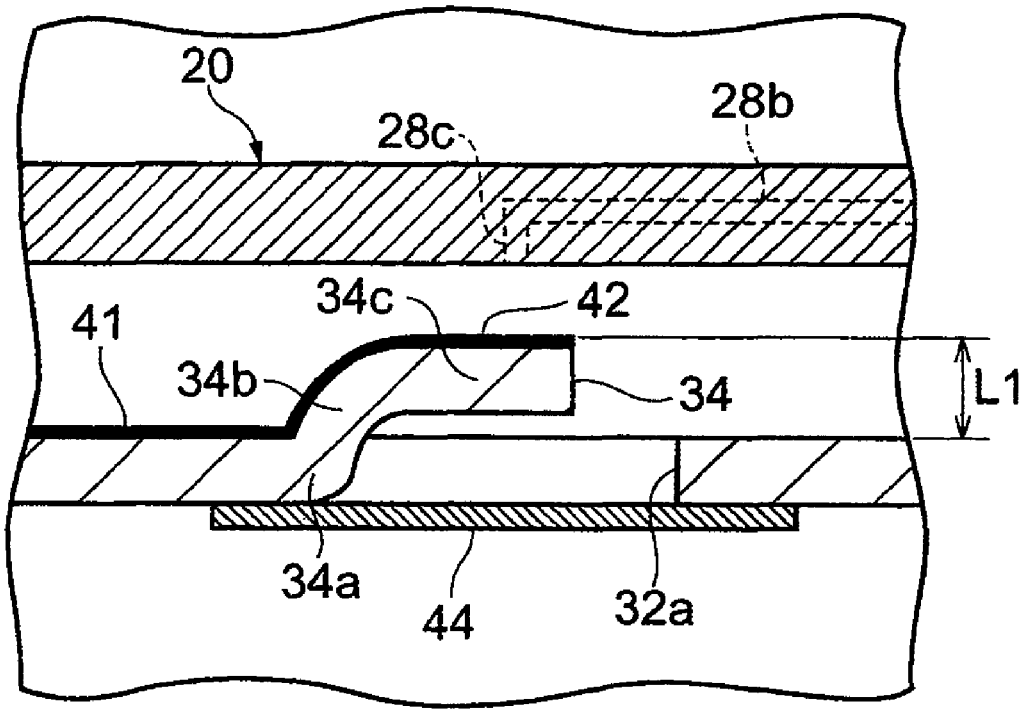
FIG. 3 is an enlarged sectional view of the portable electronic device in a state before the electronic device is assembled.
Figure 4:
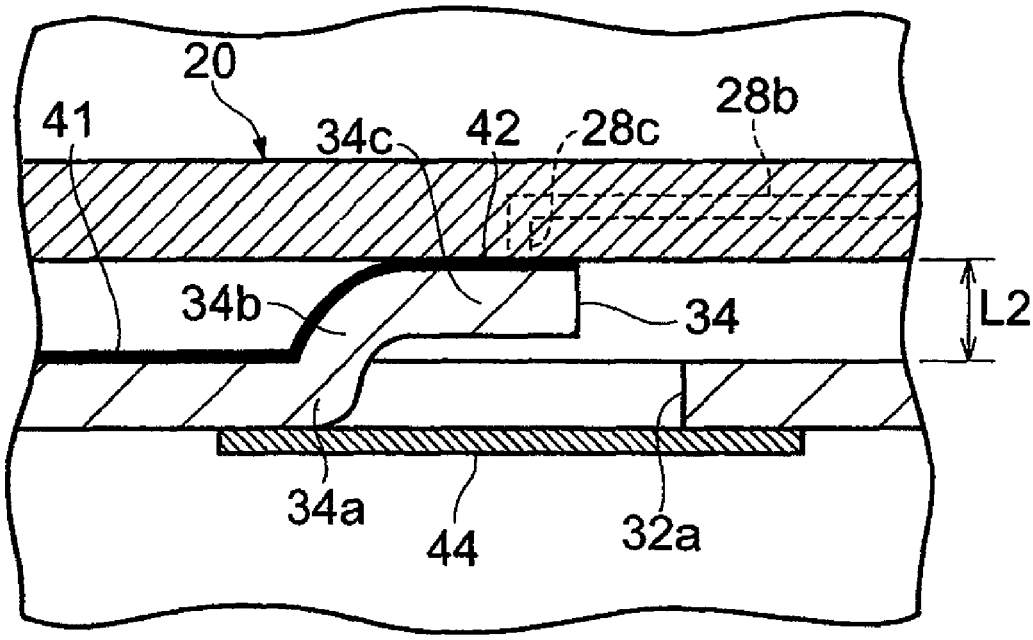
FIG. 4 is an enlarged sectional view of the portable electronic device after the electronic device is assembled.
Figure 5:
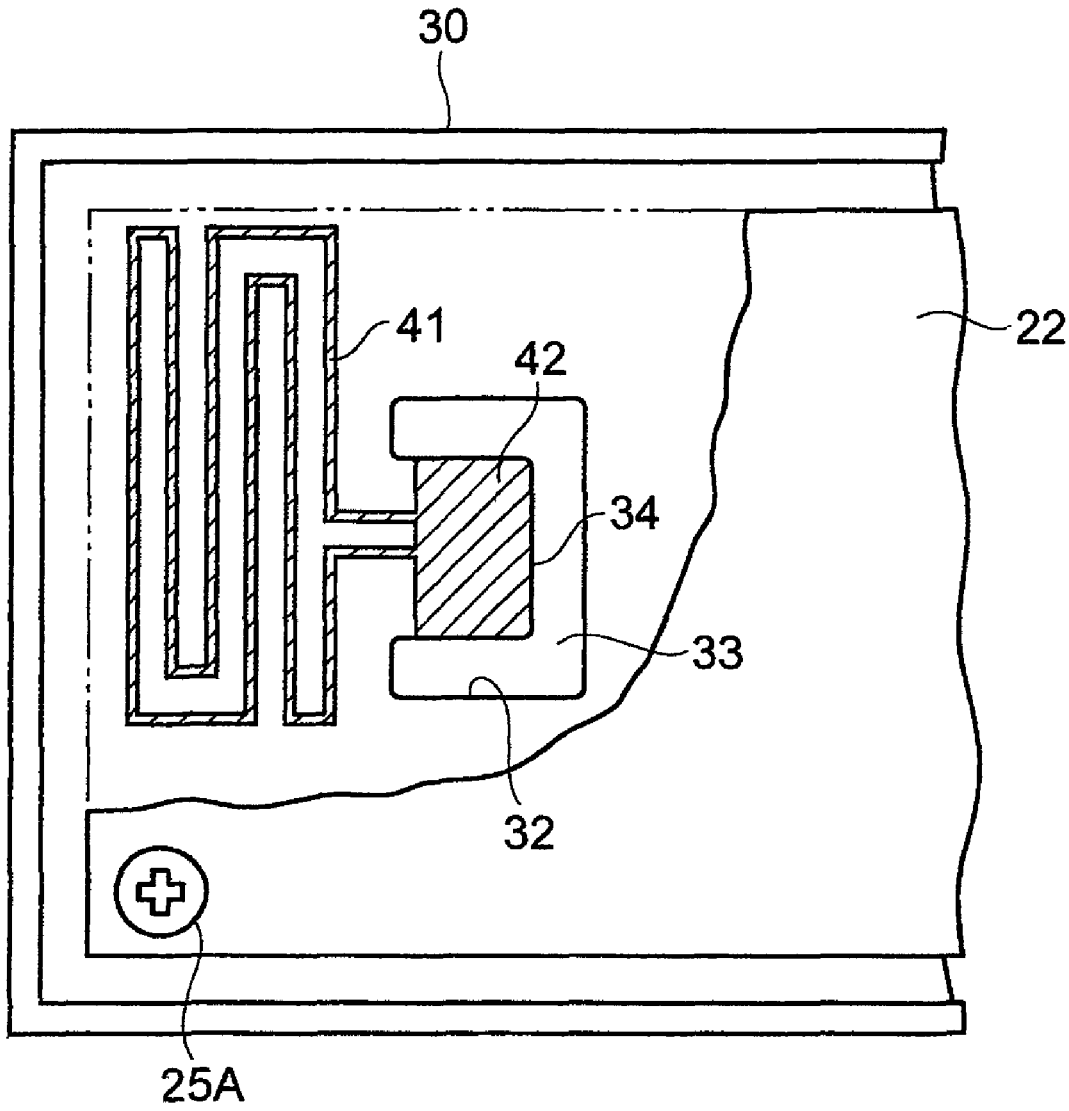
FIG. 5 is a top view of the portable electronic device according to the embodiment.

FIG. 1 is an exploded view of the electronic device 1 having a wireless communication function. FIG. 2 is a sectional side view showing the electronic device 1. FIGS. 3 and 4 are enlarged sectional views in which a part of the electronic device 1 shown in FIG. 2 is enlarged. FIG. 5 is a top view showing the electronic device 1. In FIGS. 1 to 5, the configuration of the electronic device 1 is shown in a simplified manner. Specifically, in the electronic device 1, a plurality of sets of wireless communication modules 24 and antenna patterns 40 are actually provided in the electronic device 1, however, in FIGS. 1 to 5, only one set of a wireless communication module 24 and an antenna pattern 40 is shown to easily understand the configuration of the electronic device 1.

The electronic device 1 has the printed circuit board 20 arranged in the case 100. The case 100 is formed by coupling an upper case half 10 and a lower case half 30. The upper case half 10 includes an upper plate part 10*a* as a planar member forming a rectangular upper face of the electronic device 1 and four side plate parts 10*b*, 10*c*, 10*d* and 10*e* forming side faces of the electronic device 1 (see FIG. 1). The lower case half 30 includes a lower plate part 30*a* as a planar member forming a rectangular bottom face of the electronic device 1 and four side plate parts 30*b*, 30*c*, 30*d* and 30*e* forming side faces of the electronic device 1.

The lower end edge parts of the side plate parts 10*b*, 10*c*, 10*d* and 10*e* of the upper case half 10 are overlapped and fixed on the upper end edge parts of the side plate parts 30*b*, 30*c*, 30*d* and 30*e* of the lower case half 30, so that the periphery of the printed circuit board 20 is covered. The upper case half 10 and the lower case half 30 are structure members for structurally supporting the electronic device 1. After the electronic device 1 is assembled, the printed circuit board 20 and the lower plate part 30*a* of the lower case half 30 are arranged at positions close to each other.

The upper case half 10 and the lower case half 30 are made of a plastic (a resin) as a material with a property elastically deformed when an external force is exerted on them. However, since the upper case half 10 and the lower case half 30 are the structure members having a sufficient thickness to protect parts provided therein, even when the cases receive the external force, an elastic deformation is relatively small. In the embodiment, the upper case half 10 and the lower case half 30 are made of the plastic as the material, however, the upper case half 10 and the lower case half 30 may be made of other types of elastic material.

The printed circuit board 20 is a multi-layer printed wiring board on which many components are mounted. In FIGS. 1 to 4, the printed circuit board 20 is simplified and shown under a state that only the wireless communication module 24 is mounted on the upper face of the printed circuit board 20. In corner parts of the printed circuit board 20, two through holes 26A and 26B are formed. In the lower case half 30, two screw holes 36A and 36B having female screws are formed at positions corresponding to the through holes 26A and 26B. Screw members 25A and 25B having male screws are inserted into the through holes 26A and 26B of the printed circuit board 20 and screwed into the screw holes 36A and 36B of the lower case half 30. Thus, the screw members 25A and 25B are screwed to the screw holes 36A and 36B of the lower case half 30 so that the printed circuit board 20 is fixed to the lower case half 30. In other words, the screw members 25A and 25B are fixing members for fixing the printed circuit board 20 to the lower case half 30 at positions close to each other.

The wireless communication module 24 is mounted on the upper face of the printed circuit board 20, however, the antenna pattern 40 is provided in a bottom face side of the printed circuit board 20. Accordingly, to electrically connect the wireless communication module 24 to the antenna pattern 40, one feed line 28*a*, 28*b* and 28*c* is extended in the printed circuit board 20 (see FIG. 2). That is, on the printed circuit board 20, a through hole is formed in a position where the wireless communication module 24 is mounted and the feed line 28*a* reaches an intermediate layer of the printed circuit board 20 via this through hole. The feed line 28*b* is extended in the intermediate layer of the printed circuit board 20 toward the antenna pattern 40. In the printed circuit board 20, a through hole is formed in the vicinity of the antenna pattern 40 and the feed line 28*c* reaches the bottom face of the printed circuit board 20 via the through hole from the intermediate layer.

The antenna pattern 40 is formed on the lower case half 30. The antenna pattern 40 is formed as a thin plated layer formed by plating the inner surface of the lower case half 30 with electrically conductive metal. The antenna pattern 40 includes an antenna part 41 for transmitting and/or receiving a radio signal and a feeder part 42 for electrically connecting the feed line 28*c* to the antenna part 41. In the embodiment, the antenna pattern 40 is formed as the plated layer, however, the antenna pattern 40 may be a printed layer formed by printing the inner surface of the lower case half 30 with electrically conductive metal.

The feed line 28*c* of the printed circuit board 20 is connected to the feeder part 42 of the antenna pattern 40 so that the wireless communication module 24 can transmit and receive the radio signal through the antenna part 41. In the embodiment, a special connector member is not required to connect the feed line 28*c* of the printed circuit board 20 to the feeder part 42 of the antenna pattern 40. In place of the special connector member, the form of the lower case half 30 has a special structure as described below.

On the surface of the lower case half 30, a slightly rounded rectangular through hole 33 is formed in the vicinity of the antenna pattern 40 (see FIGS. 1 and 5). A part of the lower case half 30 on which the through hole 33 is formed designates an opening 32 of the lower case half 30. The through hole 33 is formed in the lower case half 30 so that an edge wall 32*a* of the opening 32 is exposed (see FIG. 4).

A flexible planar piece 34 as a flexible planar member is extended to a central part of the opening 32 from the edge wall 32*a* of the opening 32 of the lower case half 30. The flexible planar piece 34 is formed integrally with the lower case half 30 by an injection molding process of a plastic (resin). Here, since the flexible planar piece 34 is made of the plastic as an elastic material and formed in the shape of a cantilever extended from the edge wall 32*a* of the opening 32, when a force is applied to an end thereof, the flexible planar piece 34 is largely bent. Since the flexible planar piece 34 has a configuration extending to the central part of the opening 32 from the edge wall 32*a* of the opening 32, the opening 32 forms the through hole 33 in all directions excluding a base part 34*a* of the flexible planar piece 34 (see FIG. 5).

As shown in FIG. 4, the flexible planar piece 34 includes the base part 34*a* connected to the edge wall 32*a* of the opening 32, an extending part 34*b* extending toward the central part of the through hole 33 from the base part 34*a* and an abutting part 34*c* located at a central part of the through hole 33. The base part 34*a* of the flexible planar piece is connected to the lower case half 30 in the edge wall 32*a* of the opening 32 in the antenna part 41 side. The base part 34*a* of the flexible planar piece 34 gently changes the extending direction of the flexible planar piece 34 relative to the surface of the lower case half 30 and is bent toward the printed circuit board 20 side relative to the surface of the lower case half 30.

The extending part 34*b* of the flexible planar piece 34 extends with an inclination relative to the lower case half 30 so as to be directed toward the printed circuit board 20 from the lower case half 30. In a position of the extending part 34*b* near the base part 34*a*, an inclination angle of the extending part 34*b* relative to the lower case half 30 and the printed circuit board 20 is relatively large. However, the extending part 34*b* gradually changes its extending direction. In a part of the extending part 34*a* near the abutting part 34*c*, the extending part 34*b* is substantially parallel to the lower case half 30 and the printed circuit board 20.

The abutting part 34*c* of the flexible planar piece 34 is located at the end of the extending part 34*b* and at a position opposed to the feed line 28*c*. The abutting part 34*c* more protrudes toward the printed circuit board 20 side than a peripheral part of the lower cover 30 and extends in parallel with the printed circuit board 20. The abutting part 34*c* abuts on the printed circuit board 20 after the electronic device 1 is assembled to press the feeder part 42 formed on the abutting part 34*c* to the feed line 28*c*. Since the upper face of the abutting part 34*c* of the flexible planar piece 34 has an extent to some degree, the feeder part 42 is assuredly connected to the feed line 28*c*.

A dimension L2 to the printed circuit board 20 from the inner surface of the lower case half 30 after the printed circuit board 20 is fixed to the lower case half 30 is designed to be smaller than a dimension L1 to the upper face of the abutting part 34*c* of the flexible planar piece 34 from the inner surface of the lower case half 30 before the printed circuit board 20 is fixed to the lower case half 30 (see FIGS. 3 and 4). Therefore, under a state that the printed circuit board 20 is fixed to the lower case half 30, the extending part 34*b* of the flexible planar piece 34 is elastically deformed and bent downward and the abutting part 34*c* of the flexible planar piece 34 is pressed to the bottom face of the printed circuit board 20 due to a reaction by the bending Thus, the feeder part 42 formed in the abutting part 34*c* of the flexible planar piece 34 is pressed to the feed line 28*c* in the bottom face of the printed circuit board 20 under a stable state, so that the antenna part 41 and the wireless communication module 24 are electrically connected to each other.

In the electronic device 1 configured as described above, since the through hole 33 is formed in the lower case half 30 at a position corresponding to the feed line 28*c* of the printed circuit board 20 and the flexible planar piece 34 extends from the edge wall 32*a* of the through hole 33, the flexible planar piece 34 can be largely bent. The lower case half 30 on which the flexible planar piece 34 is formed has a sufficient thickness so that the lower case half 30 is hardly elastically deformed. However, since the flexible planar piece 34 is extended from the edge wall 32*a* of the through hole 33 so that the flexible planar piece 34 is freely deformed, the flexible planar piece 34 can be largely bent. Accordingly, after the electronic device 1 is assembled, the abutting part 34*c* as the end of the flexible planar piece 34 is strongly pressed to the feed line 28*c* of the printed circuit board 20 under a stable state. Thus, the abutting part 34*c* of the antenna part 41 side can be connected to the feed line 28*c* of the wireless communication module 24 side under a stable state.

To an outer side face of the lower case half 30, a seal member 44 is adhered so as to close the through hole 33 of the opening 32. Thus, the through hole 33 formed on the lower case half 30 can be hidden and dust or dirt can be prevented from entering the inner part of the electronic device 1 through the through hole 33.

According to the electronic device 1 of the embodiment, since the special connectors, which is required in the conventional configuration to connect the wireless communication module 24 to the antenna part 41, are not required, the number of parts of the electronic device 1 can be reduced. That is, since the electronic device 1 of the embodiment has a structure that the printed circuit board 20 and the lower case half 30 are arranged at the positions close to each other so that the flexible planar piece 34 abuts on the printed circuit board 20 under a state that the flexible planar piece 34 is bent to connect the feeder part 42 formed in the flexible planar piece 34 to the feed line 28*c*, the wireless communication module 24 can be connected to the antenna part 41 without using the special connectors.

Figure 6:
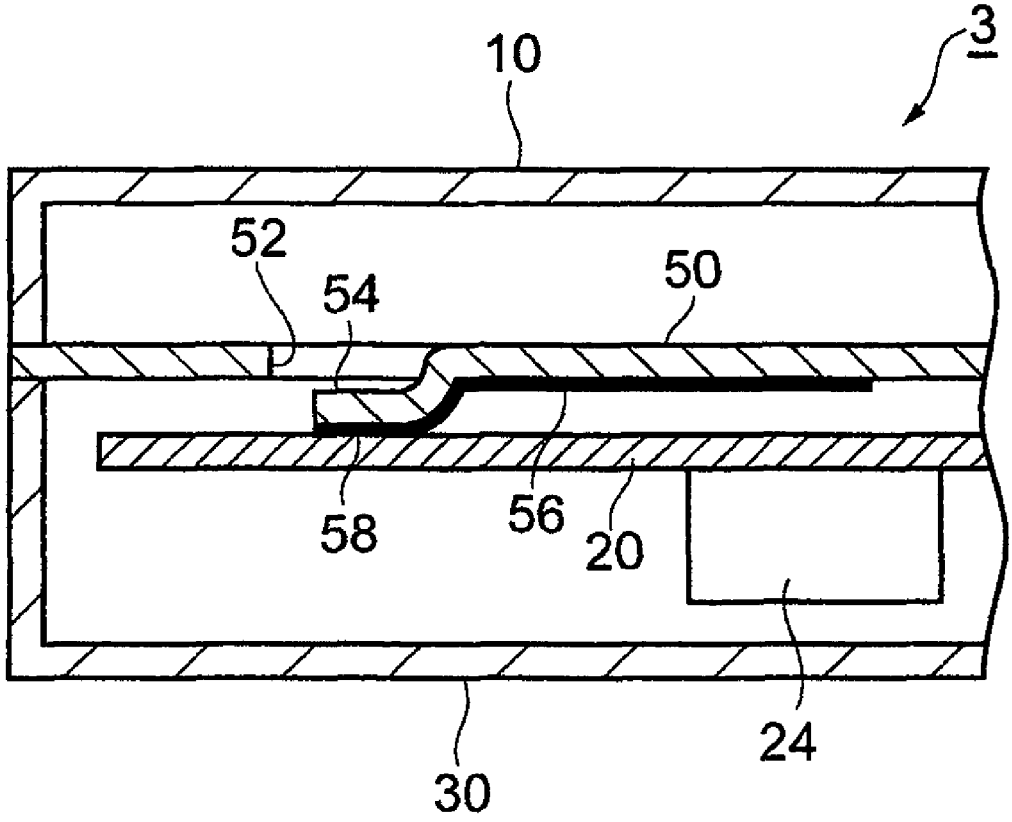
FIG. 6 is a sectional side view of a portable electronic device according to a modified example.

Now, referring to FIG. 6, a modified example of a portable electronic device 3 related to the above-described embodiment will be described below. FIG. 6 is a sectional view showing the portable electronic device 3 according to the modified example from a side part.

In the portable electronic device 3 according to the modified example, a center frame 50 is inserted between an upper case half 10 and a lower case half 30. The center frame 50 is a flat planar member arranged in parallel with a printed circuit board 20 and a structure member for structurally supporting the electronic device 3. In the center frame 50, a flexible planar piece 54 and an opening 52 are formed. On the bottom face of the center frame 50, an antenna pattern 56 and a feeder part 58 are formed. The feeder part 58 is formed in the flexible planar piece 54 and the antenna pattern 56 is formed at a position close to the flexible planar piece 54. The flexible planar piece 54 is bent so that a wireless communication module 24 is connected to the antenna pattern 56, as described above.

What is claimed is:

1. An electronic device comprising:

a circuit board comprising a wireless communication module mounted on the circuit board and a feed line formed on the circuit board and electrically connected to the wireless communication module;

a case configured to accommodate the circuit board therein, the case comprising a wall comprising:

an antenna pattern configured to electrically connect to the feed line; and an opening formed on the wall;

wherein the case comprises a flexible planar piece formed to protrude toward the circuit board from an edge of the opening, wherein the antenna pattern comprises a feeder formed on the flexible planar piece, wherein the feed line and the feeder are electrically connected under a state that the flexible planer piece is bent by accommodating the circuit board in the case, and wherein the flexible planar piece comprises:

a base portion connected to a through hole edge wall of the opening;

an extending portion extending from the base portion with an inclination with respect to the wall of the case; and an abutting portion provided at a leading end of the extending portion and configured to abut the circuit board.

2. The device of claim 1, further comprising a fixing member that is configured to fix the circuit board inside the case.

3. The device of claim 2, wherein the fixing member is a screw screwed to a screw hole formed on the case through a through hole formed on the circuit board.

4. The device of claim 3, wherein the antenna pattern is a thin layer formed on a surface inside the case by a plating process or a printing process.

5. The device of claim 4, wherein the case is made of elastic resin material.

6. The device of claim 5, wherein the case is configured to structurally support the electronic device.

* * * * *